US008888726B2

(12) United States Patent
Chen

(10) Patent No.: US 8,888,726 B2
(45) Date of Patent: Nov. 18, 2014

(54) TWO DIMENSIONAL MOVING MASSAGE DEVICE

(76) Inventor: Jui Yao Chen, Changhua County (TW)

( * ) Notice: Subject to any disclaimer, the term of this patent is extended or adjusted under 35 U.S.C. 154(b) by 467 days.

(21) Appl. No.: 13/417,233

(22) Filed: Mar. 10, 2012

(65) Prior Publication Data

US 2013/0237887 A1 Sep. 12, 2013

(51) Int. Cl.
*A61H 1/00* (2006.01)
*A61H 7/00* (2006.01)

(52) U.S. Cl.
USPC ..... 601/112; 601/84; 601/98

(58) Field of Classification Search
CPC ..... A61H 2201/0149; A61H 2201/163; A61H 23/00; A61H 23/006; A61H 7/007
USPC ..... 601/49, 85–87, 89–91, 97–100, 601/103–104, 112–113, 134, 84
See application file for complete search history.

(56) References Cited

U.S. PATENT DOCUMENTS 8,066,652 B2 * 11/2011 Wu et al. ..... 601/87
8,182,436 B2 * 5/2012 Zhong ..... 601/84
2004/0106882 A1 * 6/2004 Tseng ..... 601/86
2005/0020946 A1 * 1/2005 Kim ..... 601/15
2005/0080365 A1 * 4/2005 Wu et al. ..... 601/98
2007/0118059 A1 * 5/2007 Luo ..... 601/86
2009/0093742 A1 * 4/2009 Ferber et al. ..... 601/112
2011/0087139 A1 * 4/2011 Ferber et al. ..... 601/134
2011/0160627 A1 * 6/2011 Huang ..... 601/46

* cited by examiner

*Primary Examiner* — Justine Yu
*Assistant Examiner* — Christopher Miller
(74) *Attorney, Agent, or Firm* — Alan D. Kamrath; Kamrath IP Lawfirm, P.A.

(57) ABSTRACT

A two dimensional moving massage device includes a base, a first movable device in the base, a second movable device in the first movable device, and two massage assemblies disposed on the second movable device. The first stage power gear of the first motor cooperates with the toothed bar of the base to make the first movable device move in the up-and-down direction. The left-and-right moving driven gear is restricted to only be movable in the left-and-right direction and in the up-and-down direction by the first guiding portions and the direction restricting groove. Therefore, rotation of the left-and-right moving driven gear will be converted into displacement of the left-and-right moving driven gear along the left-and-right direction and the up-and-down direction. The massage assembly disposed on the second movable device is also capable of moving both in the up-and-down and left-and-right directions.

8 Claims, 6 Drawing Sheets

TWO DIMENSIONAL MOVING MASSAGE DEVICE

BACKGROUND OF THE INVENTION

1. Field of the Invention

The present invention relates to a massage device and, more particularly, to a two dimensional moving massage device.

2. Description of the Prior Art

Today, people are living under great pressure and therefore need to release stress by using some massage devices. Normally, massage devices are provided with massage heads to carry out a massage operation by ways of rotation, kneading or up and down movement. However, the conventional massage ways of rotating, kneading or movement might not be able to satisfy the demands of different users. Furthermore, the structure for moving the massage heads should normally be used in combination with guiding rails in such a manner that the massage heads are provided with guiding members. A drive member drives the massage heads to rotate, to make the guiding members move along the rail. It is clear that the rotation of the massage heads cause the displacement of the same. However, such arrangements would restrict the action of massage or displacement.

The present invention has arisen to mitigate and/or obviate the afore-described disadvantages.

SUMMARY OF THE INVENTION

The primary object of the present invention is to provide a two dimensional moving massage device which is capable of performing different massage movements to meet different users' different demands.

To achieve the above object, a two dimensional moving massage device in accordance with the present invention comprises: a base, a first movable device movably disposed in the base, a second movable device movably disposed in the first movable device, and two massage assemblies disposed on the second movable device.

The base is provided with a toothed bar extending in an up-and-down direction, and a direction perpendicular to the up-and-down direction is defined as a left-and-right direction.

The first movable device is disposed in the base and provided with a first guiding portion extending in the left-and-right direction and a direction restricting groove extending in the up-and-down direction. In the first movable device are provided a first motor, a first stage idler gear and a second stage idler gear. The first stage idler gear is rotated by the first motor, and the second stage idler gear is concentric and rotates together with the first stage idler gear. The second stage idler gear extends out of the first movable device and is engaged with the toothed bar.

The second movable device is received in the first movable device and provided at a bottom thereof with a guiding groove, and the first guiding portion of the first movable device is slidably inserted in the guiding groove of the second movable device. In the second movable device are disposed a second motor, a massage gear, a first stage drive gear, a first stage driven gear, and a left-and-right moving driven gear.

The second motor is provided with a rotary shaft.

The massage gear is pivotally disposed on the second movable device and rotates with the first stage drive gear.

The first stage driven gear is pivotally disposed on the second movable device and rotates with the massage gear. The left-and-right moving driven gear is eccentrically provided with a direction restricting pin which extends out of the second movable device and into the direction restricting groove of the first movable device.

The massage assembly includes a massage head mounted on the second movable device and extends out of the first movable device.

The first stage idler gear of the first motor cooperates with the toothed bar of the base to make the first movable device move in the up-and-down direction, and the left-and-right moving driven gear is restricted to only be movable in the left-and-right direction and in the up-and-down direction by the first guiding portion and the direction restricting groove. Therefore, rotation of the left-and-right moving driven gear will be converted into displacement of the left-and-right moving driven gear along the left-and-right direction and the up-and-down direction. The massage assembly disposed on the second movable device is also capable of moving both in the up-and-down and left-and-right directions.

DETAILED DESCRIPTION OF THE PREFERRED EMBODIMENTS

The present invention will be clearer from the following description when viewed together with the accompanying drawings, which show, for purpose of illustration only, the preferred embodiments in accordance with the present invention.

Figure 1:
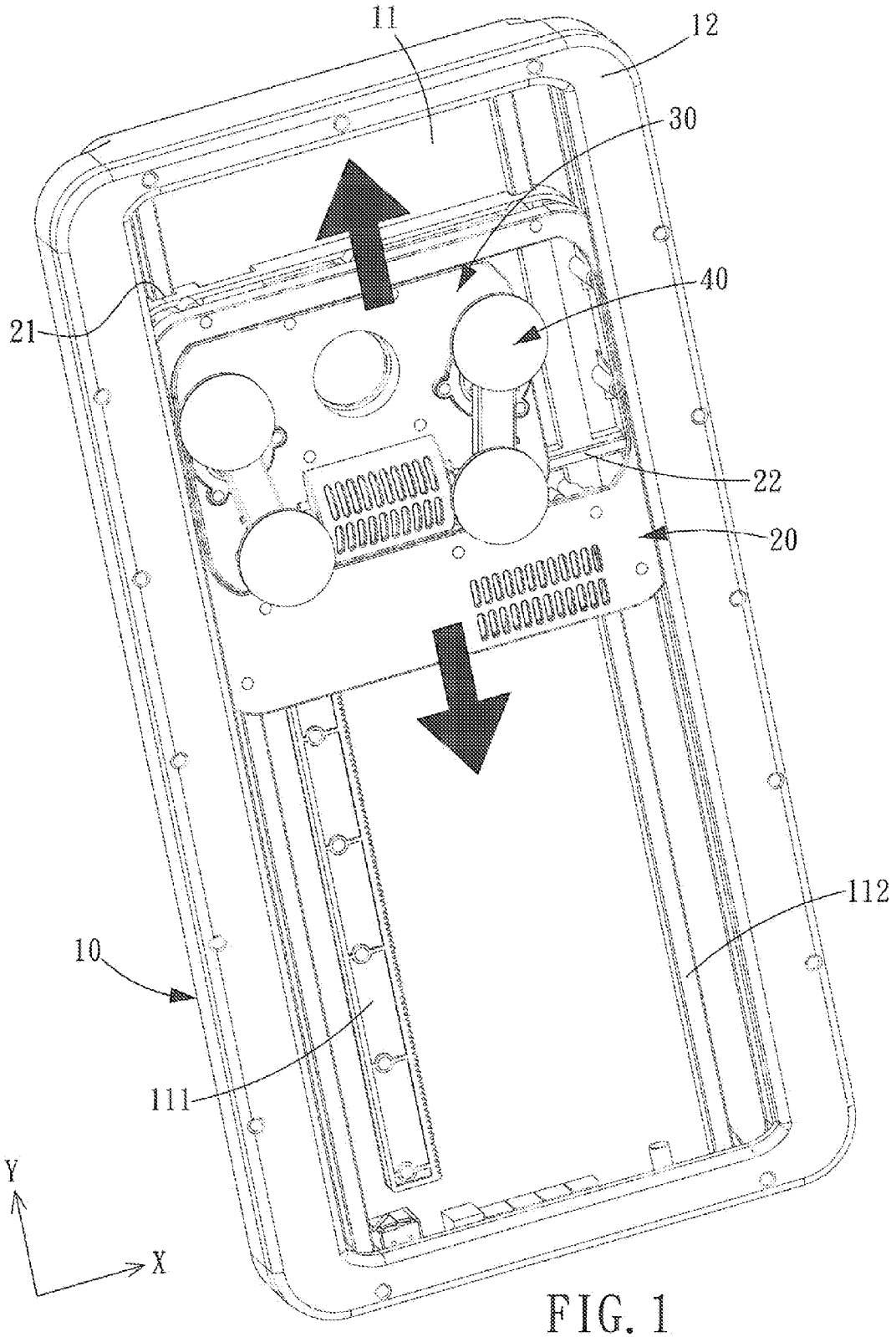
FIG. 1 is an illustrative view showing up and down movement of a two dimensional moving massage device in accordance with the present invention.
Figure 2:
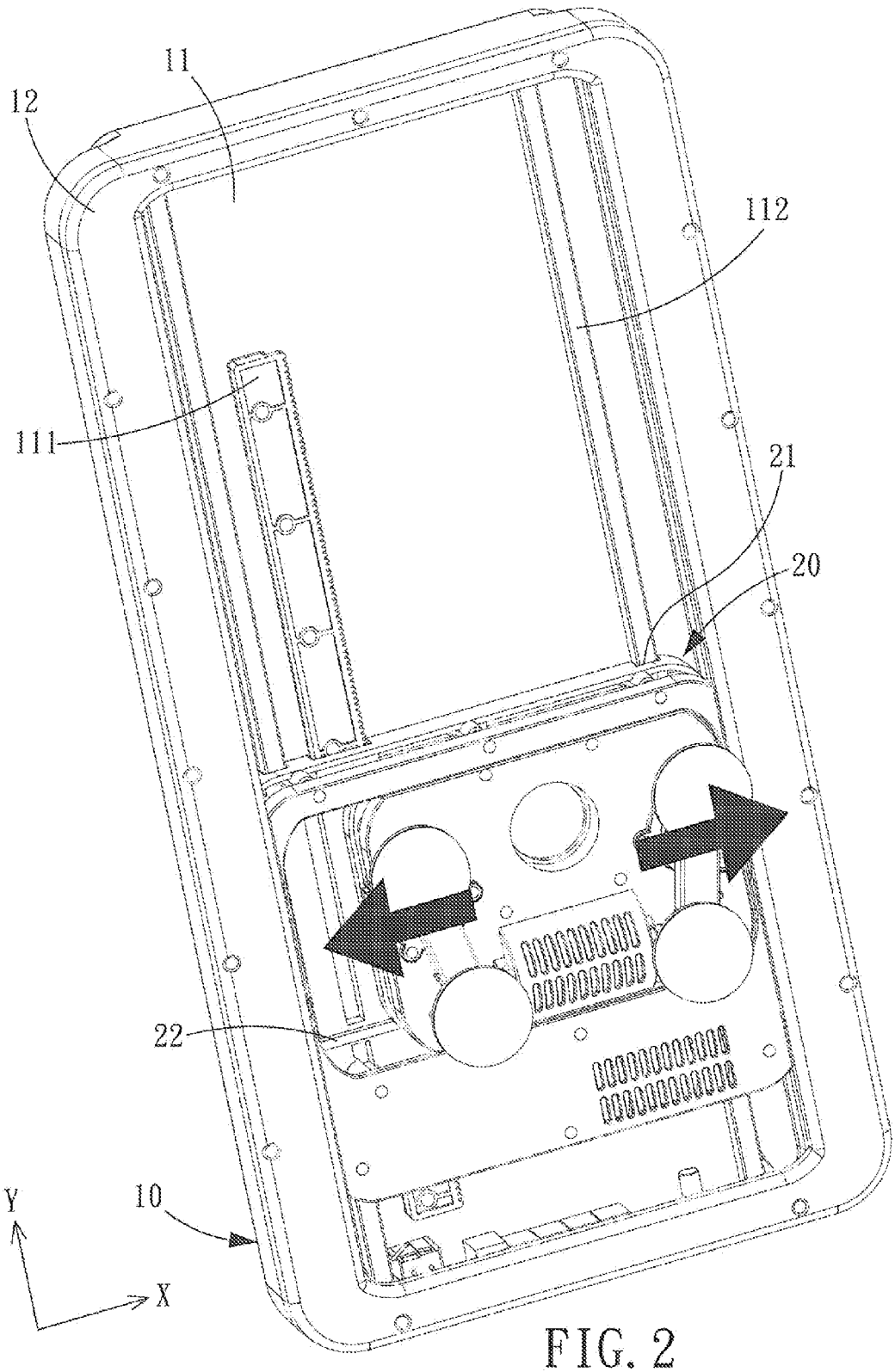
FIG. 2 is an illustrative view showing left and right movement of the two dimensional moving massage device in accordance with the present invention.
Figure 3:
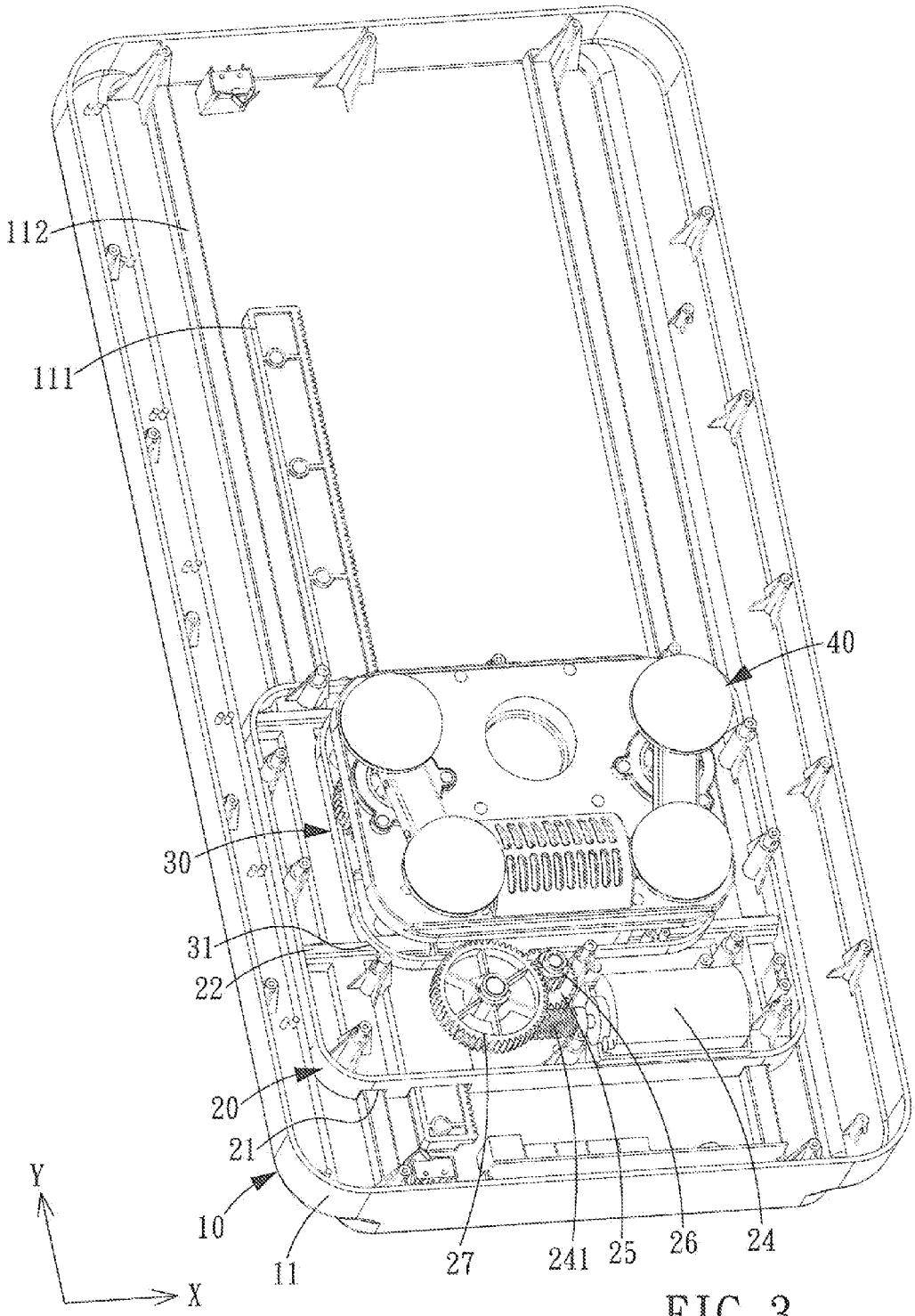
FIG. 3 is an assembly view of the two dimensional moving massage device in accordance with the present invention.
Figure 4:
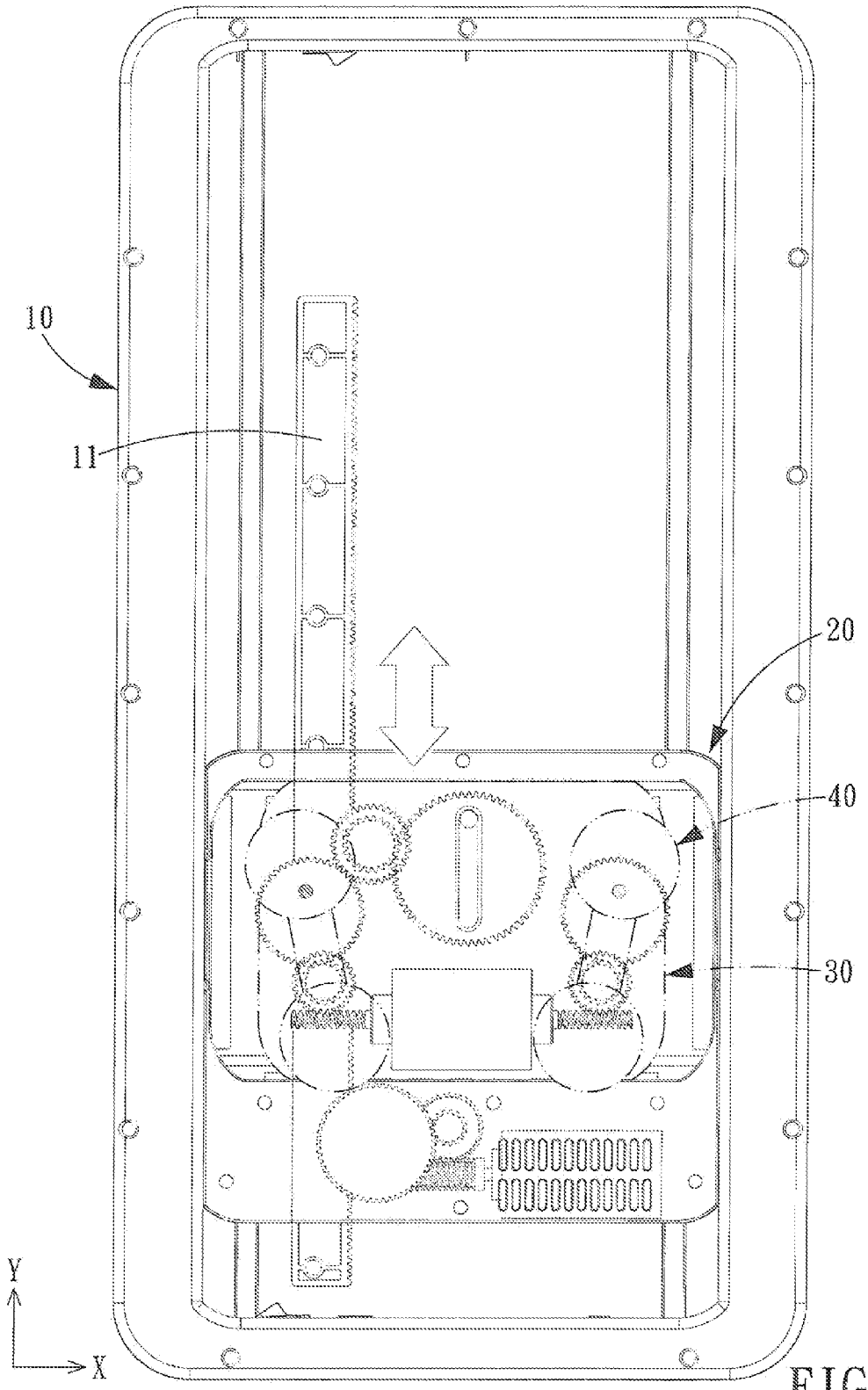
FIG. 4 is a perspective view of the two dimensional moving massage device in accordance with the present invention.
Figure 5:
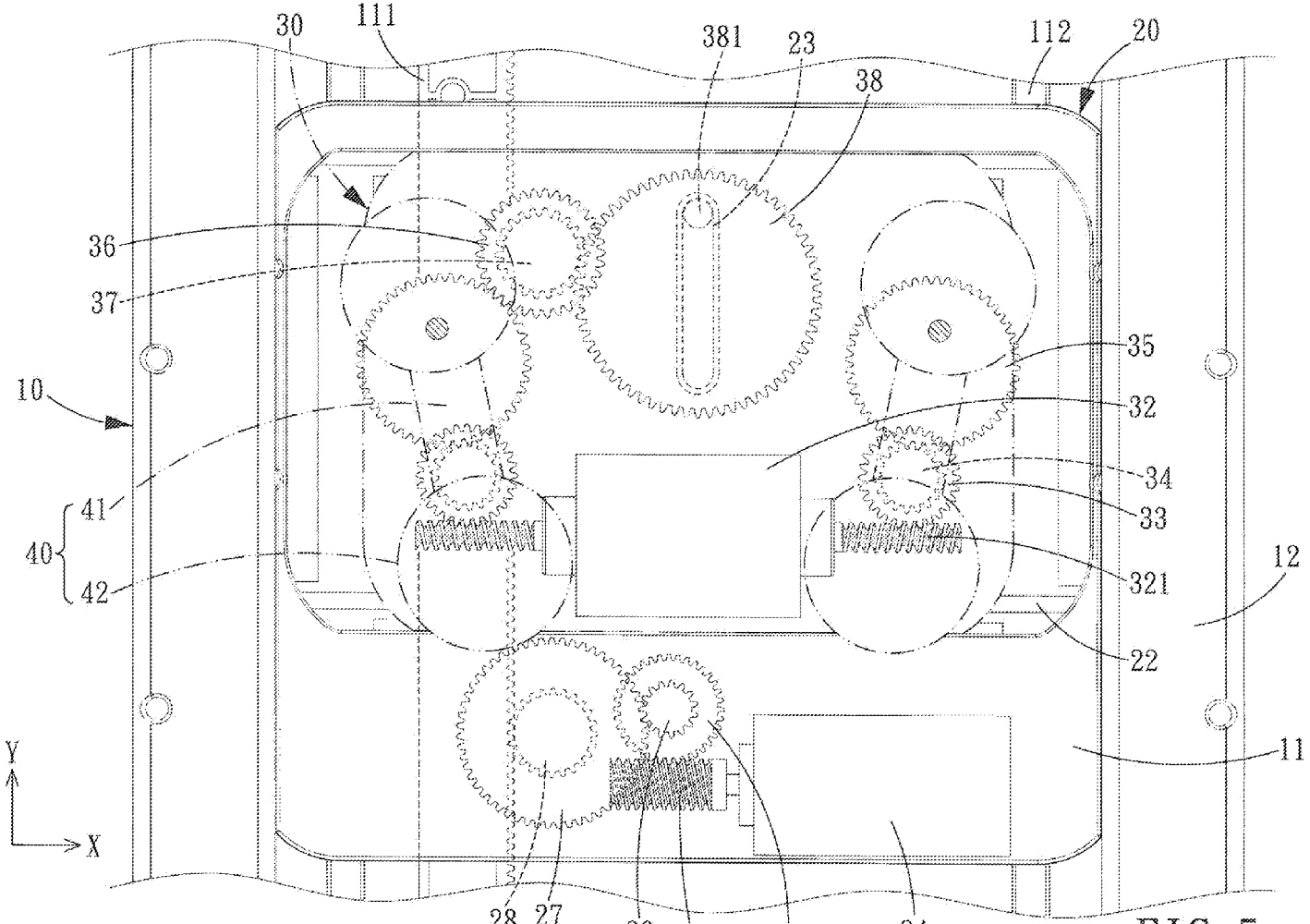
FIG. 5 is a magnified view of a part of FIG. 4.
Figure 6:
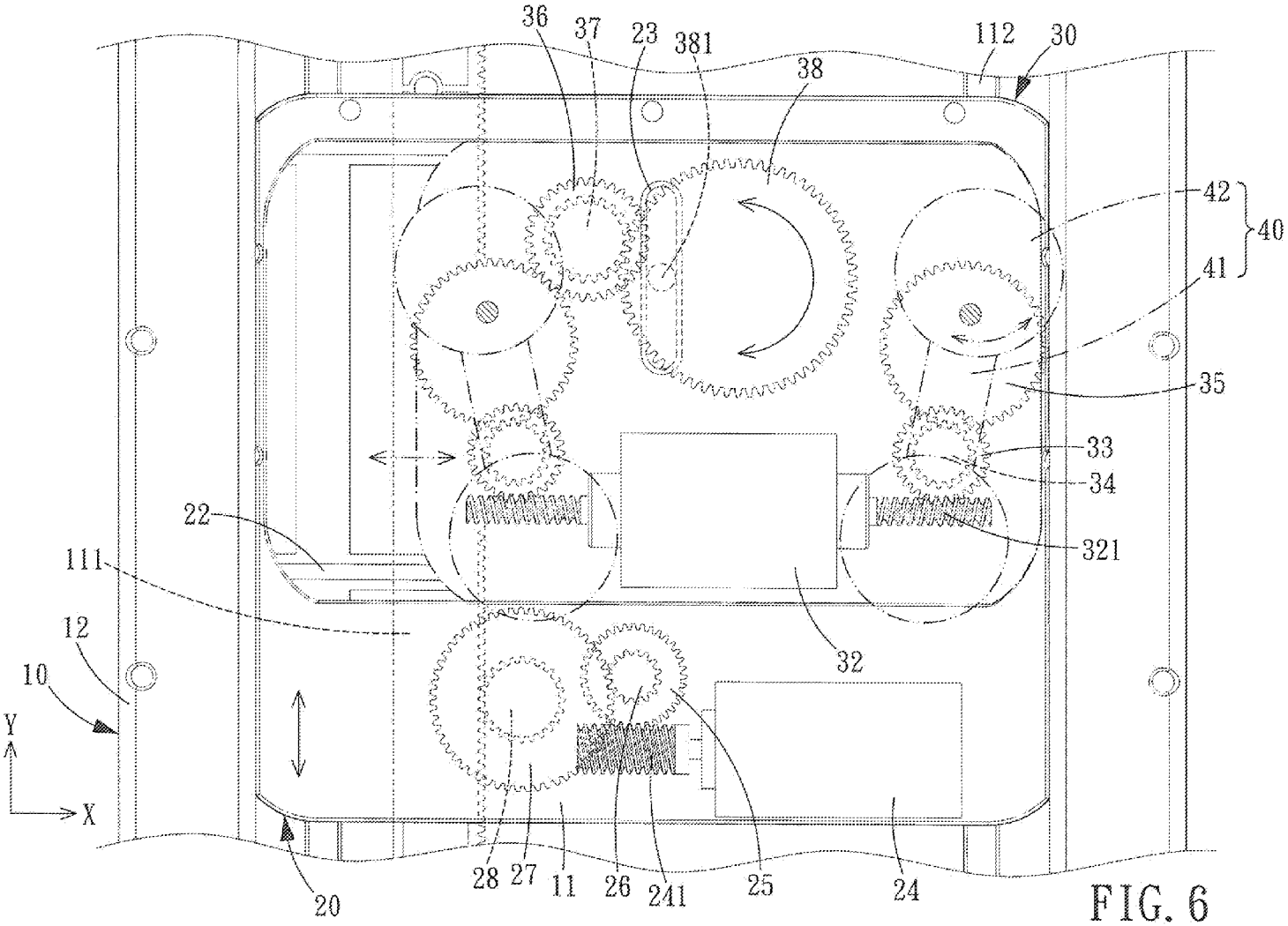
FIG. 6 is an operational view of FIG. 5.

Referring to FIGS. 1-6, a two dimensional moving massage device in accordance with the present invention comprises a base 10, a first movable device 20 movably disposed in the base 10, a second movable device 30 movably disposed in the first movable device 20, and two massage assemblies 40 disposed on the second movable device 30.

The base 10 is formed by a lower shell 11 and an upper shell 12 which are assembled together. The lower shell 11 is provided with a toothed bar 111 and a plurality of guiding portions 112. The toothed bar 111 and the guiding portions 112 extend in an up-and-down direction Y, and a direction perpendicular to the up-and-down direction Y is defined as a left-and-right direction X.

The first movable device 20 is provided at the bottom thereof with a plurality of first guiding grooves 21 extending in the up-and-down direction Y, and the guiding portions 112 of the lower shell 11 are slidably inserted in the first guiding grooves 21 of the first movable device 20. The first movable device 20 is provided with a plurality of first guiding portions 22 extending in the left-and-right direction X and a direction restricting groove 23 extending in the up-and-down direction Y. On the first movable device 20 are further provided a first motor 24, a first stage power gear 25, a second stage power gear 26, a first stage idler gear 27 and a second stage idler gear 28. The first motor 24 includes a rotary shaft 241 and is fixed on the lower shell 11. The first stage power gear 25 is pivotally disposed in the first movable device 20 and engaged with the rotary shaft 241 of the first motor 24. The second stage power gear 26 is concentrically mounted on and rotates together with the first stage power gear 25. The first stage idler gear 27 is pivotally disposed on the lower shell 11 and engaged with the second stage power gear 26. The second stage idler gear 28 is concentric and rotates together with the first stage idler gear 27, and the second stage idler gear 28 extends out of the first movable device 20 and is engaged with the, toothed bar 111 of the lower shell 11.

The second movable device 30 is provided at the bottom thereof with a plurality of second guiding grooves 31, and the first guiding portions 22 of the first movable device 20 are slidably inserted in the second guiding grooves 31 of the second movable device 30. In the second movable device 30 are disposed a second motor 32, two first stage drive gears 33, two second stage drive gears 34, two massage gears 35, a first stage driven gear 36, a second stage driven gear 37, and a left-and-right moving driven gear 38.

The second motor 32 is provided with two rotary shafts 321 at two ends thereof.

The two first stage drive gears 33 are pivotally disposed on the second movable device 30 and engaged with the rotary shafts 321 of the second motor 32, respectively.

The second stage drive gears 34 are concentric and rotate together with the first stage drive gears 33.

The massage gears 35 are pivotally disposed on the second movable device 30 and engaged with the second stage drive gears 34, respectively.

The first stage driven gear 36 is pivotally disposed on the second movable device 30 and engaged with one of the two massage gears 35.

The second stage driven gear 37 is concentric and rotates together with the first stage driven gear 36.

The left-and-right moving driven gear 38 is pivotally disposed on the second movable device 30 and engaged with the second stage driven gear 37. The left-and-right moving driven gear 38 is eccentrically provided with a direction restricting pin 381 which extends out of the second movable device 30 and into the direction restricting groove 23 of the first movable device 20.

The two massage assemblies 40 each comprise an oscillating rod 41 and two massage heads 42 at two ends of the oscillating rod 41. The oscillating rod 41 has one end eccentrically fixed to the respective massage gears 35 and another end slidably disposed on the surface of the second movable device 30.

When the first motor 24 is powered on, the rotary shaft 241 rotates the first stage power gear 25, the first stage power gear 25 then rotates the second stage power gear 26, the second stage power gear 26 then rotates the first stage idler gear 27, and then first stage idler gear 27 then rotates the second stage idler gear 28. When the second stage idler gear 28 rotates, it will move linearly along the toothed bar 111 (since the second stage idler gear 28 is engaged on the toothed bar 111) and drive the first movable device 20 to move in the up-and-down direction Y. Meanwhile, the second movable device 30 disposed on the first movable device 20 and the massage assemblies 40 disposed on the second movable device 30 will also be driven to move in the up-and-down direction Y. In this way, the massage assemblies 40 are capable of performing a massage by sliding up and down.

Then, if the second motor 32 is also powered on, the rotary shaft 321 rotates the first stage drive gears 33, the first stage drive gears 33 then rotate the second stage drive gears 34, and the second stage drive gears 34 then rotate the massage gears 35. At this moment, the massage assemblies 40 on the massage gears 35 will rotate eccentrically to perform a massage in the form eccentric rotation.

Meanwhile, one of the massage gears 35 rotates the first stage driven gear 36, the second stage driven gear 37 and the left-and-right moving driven gear 38, in sequence. Since the left-and-right moving driven gear 38 is disposed on the second movable device 30, the second movable device 30 is restricted to only be movable in the left-and-right direction X by the first guiding portions 22, and the left-and-right moving driven gear 38 is restricted to be movable only in the up-and-down direction Y by the direction restricting pin 381 which is restricted in the direction restricting groove 23. Therefore, rotation of the left-and-right moving driven gear 38 will be converted into displacement of the left-and-right moving driven gear 38 along the left-and-right direction X and the up-and-down direction Y. Namely, the direction restricting pin 381 will slide in the up-and-down direction Y along the direction restricting groove 23. The second movable device 30 is restricted to be movable in the left-and-right direction X by the first guiding portion 22. Certainly, the massage assemblies 40 disposed on the second movable device 30 are also capable of moving in the left-and-right direction X.

It is clear from the above description that when the first and second motors 24, 32 are simultaneously powered on, the first movable device 20 will move in the up-and-down direction Y, and the second movable device 30 will move in the left-and-right direction X, so that the massage assemblies 40 can move in the up-and-down direction Y and left-and-right direction X along with the first and second movable devices 20, 30. Besides, the massage assemblies 40 are also capable of performing eccentric rotation. Hence, the massage device of the present invention can perform various massage movements, including two directional movement and eccentric rotation type oscillation, to satisfy different users' different requirements. Furthermore, the arrangement of the two-stage gears can reduce the size of the massage device.

While various embodiments in accordance with the present invention have been shown and described, it is clear to those skilled in the art that further embodiments may be made without departing from the scope of the present invention.

What is claimed is:

1. A two dimensional moving massage device comprising:

a base provided with a toothed bar, with the toothed bar extending in an up-and-down direction, with a direction perpendicular to the up-and-down direction being defined as a left-and-right direction;

a first movable device disposed in the base and provided with a first guiding portion extending in the left-and-right direction and a direction restricting groove extending in the up-and-down direction, with the first movable device provided with a first motor, a first stage idler gear and a second stage idler gear, with the first stage idler gear rotated by the first motor, with the second stage idler gear concentric and rotating together with the first stage idler gear, and with the second stage idler gear extending out of the first movable device and engaged with the toothed bar;

a second movable device received in the first movable device and provided at a bottom thereof with a guiding groove, with the first guiding portion of the first movable device slidably inserted in the guiding groove of the second movable device, with the second movable device disposed with a second motor, a massage gear, a first stage drive gear, a first stage driven gear and a left-and-right moving driven gear;

with the second motor provided with a rotary shaft;

with the first stage drive gear engaged with the rotary shaft;

with the massage gear pivotally disposed on the second movable device and rotatable related with the first stage drive gear;

with the first stage driven gear pivotally disposed on the second movable device and engaged with the massage gear, with the left-and-right moving driven gear eccentrically provided with a direction restricting pin which extends out of the second movable device and into the direction restricting groove of the first movable device;

with the first stage driven gear rotatably related to the left-and-right moving driven gear; and a massage assembly including a massage head mounted on the second movable device and on the massage gear and extending out of the first movable device.

2. The two dimensional moving massage device as claimed in claim 1, wherein the base is formed by a lower shell and an upper shell which are assembled together, and wherein the toothed bar is mounted on the lower shell.

3. The two dimensional moving massage device as claimed in claim 1, wherein the base is provided with a plurality of guiding portions, wherein the first movable device is provided at a bottom thereof with a plurality of first guiding grooves extending in the up-and-down direction, and wherein the plurality of guiding portions of the base is slidably inserted in the plurality of first guiding grooves of the first movable device.

4. The two dimensional moving massage device as claimed in claim 1 further comprising a first stage power gear and a second stage power gear, wherein the first motor includes a rotary shaft, wherein the first stage power gear is pivotally disposed in the base and engaged with the rotary shaft of the first motor, wherein the second stage power gear is concentrically mounted on and rotates together with the first stage power gear, and wherein the first stage idler gear is engaged with the second stage power gear.

5. The two dimensional moving massage device as claimed in claim 1 further comprising a second stage drive gear, wherein the second stage drive gear is concentric and rotates together with the first stage drive gear, and wherein the massage gear is engaged with the second stage drive gear.

6. The two dimensional moving massage device as claimed in claim 1 further comprising a second stage driven gear, wherein the second stage driven gear is concentric and rotates together with the first stage driven gear, and wherein the left-and-right moving driven gear is engaged with the second stage driven gear.

7. The two dimensional moving massage device as claimed in claim 1, wherein the second movable device includes another massage gear; wherein the massage assembly comprises two massage heads and two oscillating rods, and wherein each oscillating rod has one end eccentrically fixed to a corresponding massage gear and another end slidably disposed on a surface of the second movable device.

8. The two dimensional moving massage device as claimed in claim 1, further comprising another massage assembly; wherein the second movable device includes another massage gear; wherein the second motor is provided with another rotary shaft, with the rotary shafts at two ends of the second motor, wherein the rotary shafts are each engaged with a corresponding massage gear, respectively, and wherein the massage gears are each provided with a corresponding massage assembly, respectively.

* * * * *